US010047413B2

(12) United States Patent
Zhang et al.

(10) Patent No.: US 10,047,413 B2
(45) Date of Patent: Aug. 14, 2018

(54) METHOD FOR SMELTING MAGNESIUM QUICKLY AND CONTINUOUSLY

(71) Applicant: NORTHEASTERN UNIVERSITY, Shenyang, Liaoning Povince (CN)

(72) Inventors: Ting'an Zhang, Shenyang (CN); Zhihe Dou, Shenyang (CN); Zimu Zhang, Shenyang (CN); Yan Liu, Shenyang (CN); Guozhi Lv, Shenyang (CN); Jicheng He, Shenyang (CN)

(73) Assignee: Northeastern University, Shenyang, Liaoning Province (CN)

( * ) Notice: Subject to any disclaimer, the term of this patent is extended or adjusted under 35 U.S.C. 154(b) by 240 days.

(21) Appl. No.: 15/118,205

(22) PCT Filed: Aug. 26, 2014

(86) PCT No.: PCT/CN2014/085224

§ 371 (c)(1),
(2) Date: Aug. 11, 2016

(87) PCT Pub. No.: WO2016/011696

PCT Pub. Date: Jan. 28, 2016

(65) Prior Publication Data

US 2017/0183760 A1 Jun. 29, 2017

(30) Foreign Application Priority Data

Jul. 21, 2014 (CN) ..... 2014 1 0345802

(51) Int. Cl.

| | |
|---|---|
| ***C22B 26/22*** | (2006.01) |
| ***C22B 5/04*** | (2006.01) |
| ***C22B 5/16*** | (2006.01) |
| ***C22B 1/24*** | (2006.01) |
| ***C22B 1/243*** | (2006.01) |

(52) U.S. Cl.

CPC ..... *C22B 26/22* (2013.01); *C22B 1/243* (2013.01); *C22B 1/2406* (2013.01); *C22B 5/04* (2013.01); *C22B 5/16* (2013.01)

(58) Field of Classification Search

CPC .. C22B 26/22; C22B 5/04; C22B 5/16; C22B 1/2406; C22B 1/245

USPC ..... 75/597

See application file for complete search history.

(56) References Cited

U.S. PATENT DOCUMENTS

| | | | | |
|---|---|---|---|---|
| 4,888,052 A | | 12/1989 | Harris et al. | |
| 5,658,367 A | * | 8/1997 | Jackman ..... | B22F 9/04 75/357 |

FOREIGN PATENT DOCUMENTS

| | | | |
|---|---|---|---|
| CN | 2265379 | Y | 10/1997 |
| CN | 1664135 | A | 9/2005 |
| CN | 101157989 | A | 4/2008 |
| CN | 101705374 | A | 5/2010 |
| CN | 101999005 | A | 3/2011 |
| CN | 102965524 | A | 3/2013 |

OTHER PUBLICATIONS

Yang, Zhongyu, "Light metal metallurgy", Jul. 31, 2004, ISSN: ISBN 7-5024-0837-1, p. 280, lines 28 and 29, p. 282, the last line, p. 283, lines 1-3.

* cited by examiner

*Primary Examiner* — C Melissa Koslow

(74) *Attorney, Agent, or Firm* — Muncy, Geissler, Olds & Lowe, P.C.

(57) ABSTRACT

A method for smelting magnesium quickly and continuously includes: preparing dolomite or magnesite with reductants and fluorite at a predetermined ratio, uniformly mixing the prepared ingredients to obtain pellets, and calcining the obtained pellets in an argon or nitrogen atmosphere; continuously feeding the high-temperature calcined pellets (without being cooled) under argon protection into a reduction furnace, and performing a high-temperature reduction reaction in a flowing argon atmosphere to obtain high-temperature magnesium steam; and enabling the high-temperature magnesium steam to be carried out of the high-temperature reduction furnace by an argon flow, and performing condensation to obtain metal magnesium. The present invention eliminates a vacuum system and a vacuum reduction tank, so that quick and continuous production of the metal magnesium is realized, the reduction time is shortened to 90 min or less, and the recovery rate of magnesium is increased to 88% or more.

6 Claims, No Drawings

METHOD FOR SMELTING MAGNESIUM QUICKLY AND CONTINUOUSLY

BACKGROUND OF THE INVENTION

1. Field of the Invention

The present invention belongs to the technical field of non-ferrous metallurgy, and particularly relates to a method for smelting magnesium quickly and continuously.

2. The Prior Arts

In 1950s, magnesium entered civilian market. Since 1960s, the application of magnesium in the civilian market and the space technology has promoted the development of the magnesium industry, and great breakthroughs in magnesium refining methods and production technologies have been made, thereby continuously improving economic efficiency. There are two main categories of magnesium smelting methods in the world: an electrolysis method and a heat reduction method. In the heat reduction method, calcined dolomite is used as raw materials, ferrosilicon is used as a reductant, and reduction is performed in high temperature and vacuum conditions so as to obtain metal magnesium. As the most important one, the Pidgeon magnesium smelting method adopts a simple technology, thereby greatly reducing the production cost and increasing the global yield of primary magnesium. The Pidgeon magnesium smelting method has the advantages of simplicity in operation, low investment cost and the like. However, because the Pidgeon magnesium smelting method needs to be performed in a high temperature and vacuum condition and adopts a labor-intensive intermittent operation, the Pidgeon magnesium smelting method has the defects of long-reduction cycle (10-12 h), low yield of metal magnesium (30 kg/reduction tank), high energy consumption and the like. In addition, since the reduction tank is used for a long time in a high temperature and high vacuum condition, the service life of the reduction tank is shortened and the production cost is increased. Furthermore, the used material namely dolomite needs to be calcined first and the ultrafine powder produced by calcination cannot be used, thereby resulting in serious waste of resources.

With regards to the defects of conventional silicothermic magnesium smelting method, such as long reduction period and high production cost, Chinese researchers broke through the existing standpoints of core equipment and key technology to sequentially develop novel magnesium smelting devices, as well as new ideas of aluminothermic and calciothermic magnesium smelting methods. For example, Chinese Patent Application No. 200710035929.8, Chinese Patent No. ZL 96247592.0 and others design induction heating magnesium smelting devices, wherein, Chinese Patent Application No. 200710035929.8 also designs a combination of multiple feeding devices and multiple magnesium steam condensing devices to achieve mechanical operations of magnesium smelting. Dehong Xia et al. study the idea of using a liquid calciothermic reduction method for magnesium smelting, and improve the level of automation operations by optimizing the operational technology conditions. Chinese Patent Application No. 200510045888.1 and Application No. 200910236975.3 develop new ideas about a novel metal thermal reduction for magnesium smelting method, while Chinese Patent Application No. 200510045888.1 studies the idea about thermite reduction magnesium smelting method which reduces reduction temperature by 50° C. and reduction time to 7-8 h. Chinese Patent Application No. 200910236975.3 studies a magnesium smelting technology using Si—Fe+Al+Ca composite reductants to reduce calcined and caustic magnesite mixtures, so that the reduction time is shortened to 5-9 h. Although the above researches to some extent improve the technical level of thermal magnesium smelting methods, they are improvements and enhancements derived from the basic idea of high temperature and vacuum conditions based on the conventional silicothermic magnesium smelting technology, which has no breakthrough from nature. Therefore, the defects of the conventional silicothermic magnesium smelting technology, such as long reduction cycle, high energy consumption, short life of the reduction tank and high production cost, are still not overcome fundamentally.

SUMMARY OF THE INVENTION

In order to overcome the defects and the deficiencies of the existing thermal smelting method and the defects of the conventional silicothermic process for magnesium production, such as long reduction cycle, high energy consumption, short life of the reduction tank and high production cost, the present invention provides a method for smelting magnesium quickly and continuously, that is, high-temperature reduction is performed in flowing inert gas, and besides, the generated high-temperature magnesium steam is carried away by the flowing inert carrier gas immediately and condensed so as to obtain metal magnesium. The method disclosed by the present invention has a quick reaction speed, shortens the reduction time to 90 min or less, increases the magnesium recovery rate to 88% or more, and achieves continuous production of the magnesium.

The method for smelting magnesium quickly and continuously disclosed by the present invention comprises the steps of direct pelletizing, pellet calcining, high-temperature reduction of calcined pellets in a flowing argon atmosphere, and condensing of high-temperature magnesium steam. Among the above steps, direct pelletizing refers to the steps of uniformly mixing the uncalcined dolomite or magnesite with reductants and fluorite at a certain ratio so as to obtain a mixture and pelletizing the mixture by a disc pelletizer into pellets with a diameter of 5-20 mm; pellet calcining refers to the step of calcining the pellets in an argon or nitrogen atmosphere at a temperature of 850-1050° C. for 30-120 min, so that moisture and volatile matters can be removed from the pellets and carbonates therein are decomposed to emit $CO_2$, and besides, the reductants are diffused in the calcination process to be fully in contact with MgO generated by decomposition; the high-temperature reduction of calcined pellets refers to the steps of performing a high-temperature reduction reaction on the calcined pellets in a "relatively vacuum" atmosphere and in the flowing argon atmosphere, and enabling the high-temperature magnesium steam generated in the reaction to be carried away by the flowing argon carrier gas immediately. For each reaction interface, since the high-temperature magnesium steam generated in the reaction is immediately carried away from the reaction interfaces, the partial pressure of the high-temperature magnesium steam at the reaction interfaces is always far lower than 1 atm, namely in a relatively "negative pressure state". Therefore, the atmosphere above the reduction reaction interfaces for generating magnesium steam is just like a closed container in vacuum; this is called "relatively vacuum" or "relatively negative pressure", which provides sufficient thermodynamics and dynamic conditions for the occurrence of the reaction; the condensing of the magnesium steam refers to the process of quickly condensing the high-temperature magnesium steam which is continuously carried out of a high-temperature reduction furnace by the argon gas so as to obtain the metal magnesium.

The method for smelting magnesium quickly and continuously disclosed by the present invention specifically comprises the following steps of:

Step 1: Ingredient Preparing and Pelletizing ingredient preparing: preparing dolomite, 75Si—Fe alloy and fluorite at a mass ratio of 110:(10-13):(3.0-4.0), uniformly mixing the prepared ingredients so as to obtain a mixture, and then adding soluble glass as a bonding agent which accounts for 1.0-2.0% of the total mass of the prepared ingredients and water which accounts for 2.0-5.0% of the total mass of the prepared ingredients;

or, preparing dolomite, Al and fluorite at a mass ratio of 115:(10-13):(2.0-3.0), uniformly mixing the prepared ingredients so as to obtain a mixture, and then adding soluble glass as a bonding agent which accounts for 1.0-2.0% of the total mass of the prepared ingredients and water which accounts for 2.0-5.0% of the total mass of the prepared ingredients;

pelletizing: uniformly mixing the prepared ingredients so as to obtain a mixture, pelletizing the mixture so as to obtain pellets with particle sizes of 5-20 mm, and naturally drying the pellets for 10-24 h;

Step 2: Pellet Calcining placing the dried pellets in a high-temperature furnace, a rotary kiln or a fluidized bed, heating the dried pellets to 150-250° C., keeping the temperature for 30-60 min, dehydrating the dried pellets in the temperature kept, then heating the dehydrated dried pellets to 850-1050° C. in an argon or nitrogen atmosphere, keeping the temperature, and performing calcination for 30-120 min;

Step 3: Continuous High-Temperature Reduction of Calcined Pellets continuously feeding the high-temperature calcined pellets (without being cooled) under argon protection into the closed high-temperature reduction furnace, then performing a high-temperature reduction reaction in a flowing argon atmosphere with a reduction temperature of 1300-1600° C. a reduction time of 20-90 min, and an argon flow rate of 2.0-5.0 $m^3$/h in order to continuously obtain high-temperature magnesium steam, mixing the magnesium steam with argon gas to form a high-temperature gas mixture, and besides, continuously discharging reduction slag out of the high-temperature reduction furnace; and Step 4: Condensing of High-Temperature Magnesium Steam enabling the high-temperature magnesium steam to be carried out of the high-temperature reduction furnace by the argon flow, and to be delivered through a sealed pipeline to a condensation system for condensation so as to obtain metal magnesium.

The method for smelting magnesium quickly and continuously disclosed by the present invention may also specifically comprise the following steps of:

Step 1: Ingredient Preparing and Pelletizing ingredient preparing: preparing magnesite, 75Si—Fe alloy, CaO and fluorite at a mass ratio of 45:(10-13):(16-20):(2.0-3.0), uniformly mixing the prepared ingredients so as to obtain a mixture, and then adding soluble glass as a bonding agent which accounts for 2.0-3.0% of the total mass of the prepared ingredients and water which accounts for 2.0-6.0% of the total mass of the prepared ingredients;

or, preparing magnesite, Al, CaO and fluorite at a mass ratio of 48:(10-13):(15-18):(2.0-3.0), uniformly mixing the prepared ingredients so as to obtain a mixture, and then adding soluble glass as a bonding agent which accounts for 2.0-3.0% of the total mass of the prepared ingredients and water which accounts for 2.0-6.0% of the total mass of the prepared ingredients;

Step 2: Pellet Calcining placing the dried pellets in a high-temperature furnace, a rotary kiln or a fluidized bed, heating the dried pellets to 150-250° C., keeping the temperature for 30-60 min, dehydrating the dried pellets after the temperature is kept, then heating the dehydrated dried pellets to 850-1050° C. in the argon or nitrogen atmosphere, keeping the temperature, and performing calcination for 30-120 min;

Step 3: Continuous High-Temperature Reduction of Calcined Pellets continuously feeding the high-temperature calcined pellets (without being cooled) under argon protection into the closed high-temperature reduction furnace, then performing a high-temperature reduction reaction in a flowing argon atmosphere with a reduction temperature of 1300-1600° C., a reduction time of 20-90 min, and an argon flow rate of 2.0-5.0 $m^3$/h in order to continuously obtain high-temperature magnesium steam, mixing the magnesium steam with argon gas to form a high-temperature gas mixture, and besides, continuously discharging reduction slag out of the high-temperature reduction furnace; and Step 4: Condensing of High-Temperature Magnesium Steam enabling the high-temperature magnesium steam to be carried out of the high-temperature reduction furnace by the argon flow, and delivered through a sealed pipeline to a condensation system for condensation so as to obtain metal magnesium.

According to the method for smelting magnesium quickly and continuously, the Al or 75Si—Fe alloy in Step 1 is replaced with composite reductants selected from one of the following three groups:

(1) Al+75Si—Fe alloys; (2) Ca+75Si—Fe alloys; (3) Al+Ca+75Si—Fe alloy;

the standard dosage of the composite reductants are: 1 mass unit of Al can be replaced with 2.2 mass units of Ca; 1 mass unit of 75Si—Fe alloy can be replaced with 2.2 mass units of Ca; 1 mass unit of Al is equivalent to 1 mass unit of 75Si—Fe alloy.

In Step 1, a disc pelletizer is used for pelletizing; in Step 3, the high-temperature reduction furnace is a medium-frequency induction furnace or a high-temperature resistance furnace;

the condensing way in Step 4 is direct condensation or atomizing condensation, wherein the direct condensation is circulating water condensation.

The 75Si—Fe alloy is: a Si—Fe alloy with 75% of Si by mass.

During the pellet calcination in the Step 2, the chemical reaction is as follows:

when dolomite is used as a raw material:

$$MgCO_3.CaCO_3=MgO.CaO+2CO_2 \quad (1)$$

when magnesite is used as a raw material:

$$MgCO_3=MgO+CO_2 \quad (2)$$

$MgCO_3$ and $CaCO_3$ in the pellets are completely decomposed through calcination, and the pellets are further sintered in the high-temperature calcination process, wherein the metal reductants are diffused to be fully in contact with MgO, which provides sufficient dynamic conditions for the following high-temperature reduction for generating high-temperature magnesium steam.

During the high-temperature reduction of the calcined pellets in the Step 3, the reaction equation is as follows:

when dolomite is used as a raw material:

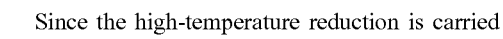

$$2MgO.CaO+Si=2Mg_{(g)}\uparrow+2CaO.SiO_2 \quad (3)$$

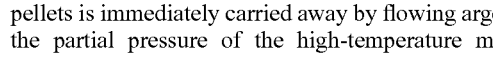

$$3MgO.CaO+2Al=3Mg_{(g)}\uparrow+3CaO.2Al_2O_3 \quad (4)$$

when magnesite is used as a raw material:

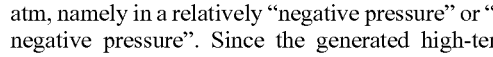

$$2MgO+2CaO+Si=2Mg_{(g)}\uparrow+2CaO.SiO_2 \quad (5)$$

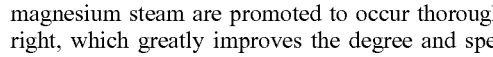

$$21MgO+12CaO+14Al=21Mg_{(g)}\uparrow+12CaO.7Al_2O_3 \quad (6)$$

Since the high-temperature reduction is carried out in a flowing inert argon atmosphere, the high-temperature magnesium steam generated in the reaction interfaces of the pellets is immediately carried away by flowing argon gas, so the partial pressure of the high-temperature magnesium steam at the reaction interfaces is always far lower than 1 atm, namely in a relatively "negative pressure" or "relatively negative pressure". Since the generated high-temperature magnesium steam is carried by inert argon gas anytime, high-temperature reduction reactions (3)-(6) for generating magnesium steam are promoted to occur thoroughly to the right, which greatly improves the degree and speed of the reduction of MgO. The reduction time is shortened to 20-90 min and the recovery rate of metal magnesium is increased to 88% or more. Meanwhile, the reduction slag is directly discharged, which achieves continuous production of metal magnesium.

Compared to the prior art, the method for smelting magnesium quickly and continuously disclosed by the present invention has the following advantages:

(1) compared with a conventional silicothermic magnesium smelting technique, the present invention eliminates a vacuum system and a vacuum reduction tank, so that the equipment is simpler; because the reduction operation is performed in "relatively vacuum" ("relatively negative pressure") conditions, the operation is simple, the requirements for equipment are low, the investment in equipment is reduced and the operating cost is reduced.

(2) According to the conventional silicothermic magnesium smelting method, dolomite or magnesite first needs to be calcined, cooled, and then pelletized. During the calcination of dolomite, fine powder of about 5% is generated but cannot be used, leading to a waste of resources. According to the method disclosed by the present invention, dolomite or magnesite without calcination is directly pelletized and the pellets are then calcined, producing no waste of fine powder. Thus, with the method disclosed by the present invention, the utilization rate of the raw materials is significantly increased, and pollution is significantly decreased.

(3) The technique disclosed by the present invention is different from the conventional silicothermic magnesium smelting technique in the following respects that: dolomite or magnesite is firstly and directly pelletized, and then the pellets are calcined in a protective atmosphere at 850-1050° C. so as to achieve quick low-temperature calcination of dolomite or magnesite; the calcined pellets without being cooled are continuously fed to the high-temperature reduction furnace for high-temperature reduction, and exhaust afterheat from calcination and exhaust afterheat from the high-temperature reduction are directly used for preheating the pellets and inert carrier gas. Thus, according to the method disclosed by the present invention, the energy consumption is significantly reduced.

(4) According to the method disclosed by the present invention, the high-temperature reduction process is carried out in a flowing inert argon atmosphere, the generated high-temperature magnesium steam is continuously carried away by the flowing argon gas, that is, a "relatively vacuum" means is used, the vacuum system and the reduction vacuum tank are eliminated, a continuous production of the metal magnesium is realized, and the reduction cycle is greatly shortened. As a result, the magnesium reduction cycle is shortened from 8-12 h of the conventional silicothermic method to 20-90 min. Also, the recovery rate of metal magnesium and the utilization of resources are greatly increased, the comprehensive recovery of metal magnesium is increased to 88% or more, and besides, and the protective inert carrier gas can be recycled. Thus, the technique disclosed by the present invention is a new environmental protecting and energy saving technology, with which the cost for producing a ton of the metal magnesium can be reduced by 4,000 Chinese Yuan or more. At the same time, the technique can be used for treating large quantities of MgO-rich boron sludge secondary resources, achieving environmental protection and clean use.

DETAILED DESCRIPTION OF THE PREFERRED EMBODIMENT

In the following embodiments:

The adopted dolomite consists of the following compositions in percentage by mass: 21.7% of MgO, 30.5% of CaO, and the balance being $CO_2$, and the total quantity of trace impurities is not more than 2.0%.

The adopted magnesite consists of the following compositions in percentage by mass: 47.05% of MgO and the balance being $CO_2$, and the quantity of trace impurities is not more than 1.5%.

The adopted argon gas is argon gas with high purity of 99.95%.

The adopted disc pelletizer has a diameter Φ of 1000 mm, a side height h of 300 mm, an inclination angle α of 45°, and a rotation speed of 28 rpm.

The adopted medium-frequency induction furnace has an induction furnace coil diameter of 200 mm.

The reduction time referred in Step 3 of the following embodiments refers to the residence time of the calcined pellets in the high-temperature reduction zone.

Embodiment 1

The method for smelting magnesium quickly and continuously specifically comprises the following steps of:

Step 1: Ingredient Preparing and Pelletizing ingredient preparing: preparing dolomite, 75Si—Fe alloy and fluorite at a mass ratio of 110:10:3.0, and then adding soluble glass as a bonding agent which accounts for 1.0% of the total mass of the above three ingredients and water which accounts for 5.0% of the total mass of the above three ingredients;

pelletizing: uniformly mixing the prepared ingredients so as to obtain a mixture, pelletizing the mixture by the disc pelletizer so as to obtain pellets with particle sizes of 5-20 mm, and naturally drying the pellets for 24 h;

Step 2: Pellet Calcining placing the dried pellets in the high-temperature furnace, heating the dried pellets to 200° C., keeping the temperature for 45 min, dehydrating the dried pellets after the temperature is kept, then heating the dehydrated dried pellets to 1050° C. in an argon atmosphere, keeping the temperature, and performing calcination for 30 min;

Step 3: Continuous High-Temperature Reduction of Calcined Pellets continuously feeding the high-temperature calcined pellets (without being cooled) under argon protection into the medium-frequency induction furnace through a sealed pipeline, then performing a continuous high-temperature reduction reaction in a flowing argon atmosphere with a reduction temperature of 1350° C., a reduction time of 90 min, and an argon flow rate of 4.5 $m^3$/h in order to continuously obtain high-temperature magnesium steam, mixing the magnesium steam with argon gas to form a high-temperature gas mixture, and besides, continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 89%.

Embodiment 2

The method for smelting magnesium quickly and continuously specifically comprises the following steps of:

Step 1: Ingredient Preparing and Pelletizing ingredient preparing: preparing dolomite, 75Si—Fe alloy and fluorite at a mass ratio of 110:12:3.5, and then adding soluble glass as a bonding agent which accounts for 1.5% of the total mass of the above three ingredients and water which accounts for 5.0% of the total mass of the above three ingredients;

pelletizing: uniformly mixing the prepared ingredients so as to obtain a mixture, pelletizing the mixture by the disc pelletizer so as to obtain pellets with particle sizes of 5-20 mm, and naturally drying the pellets for 24 h;

Step 2: Pellet Calcining placing the dried pellets in the rotary kiln, heating the dried pellets to 200° C., keeping the temperature for 45 min, dehydrating the dried pellets after the temperature is kept, then heating the dried pellets to 1000° C. in a highly pure nitrogen atmosphere, keeping the temperature, and performing calcination for 60 min;

Step 3: Continuous High-Temperature Reduction of Calcined Pellets continuously feeding the high-temperature calcined pellets (without being cooled) under argon protection into a high-temperature resistance furnace through a sealed pipeline, then performing a continuous high-temperature reduction reaction in a flowing argon atmosphere with a reduction temperature of 1450° C., a reduction time of 50 min, and an argon flow rate of 3.0 $m^3$/h in order to continuously obtain high-temperature magnesium steam, mixing the magnesium steam with argon gas so as to form a high-temperature gas mixture, and besides, continuously discharging reduction slag out of the high-temperature resistance furnace; and Step 4: Condensing of High-Temperature Magnesium Steam enabling the high-temperature magnesium steam to be carried out of the high-temperature resistance furnace by flowing argon stream, and then to be carried directly by the sealed pipeline into a magnesium condensing tank for circulating water cooling condensation so as to obtain metal magnesium ingots, with a metal magnesium recovery rate of 90%.

Embodiment 3

The method for smelting magnesium quickly and continuously specifically comprises the following steps of:

Step 1: Ingredient Preparing and Pelletizing ingredient preparing: preparing dolomite, 75Si—Fe alloy and fluorite at a mass ratio of 110:12:4.0, and then adding soluble glass as a bonding agent which accounts for 2.0% of the total mass of the above three ingredients and water which accounts for 4.0% of the total mass of the above three ingredients;

pelletizing: uniformly mixing the prepared ingredients so as to obtain a mixture, pelletizing the mixture through the disc pelletizer so as to obtain pellets with particle sizes of 5-20 mm, and naturally drying the pellets for 12 h;

Step 2: Pellet Calcining placing the dried pellets in the fluidized bed, heating the dried pellets to 250° C., keeping the temperature for 30 min, dehydrating the dried pellets after the temperature is kept, then heating the dehydrated dried pellets to 950° C. in a highly pure nitrogen atmosphere, keeping the temperature, and performing calcination for 70 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1600° C., a reduction time of 20 min, and an argon flow rate of 5.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a jet atomizer for atomizing condensation so as to obtain metal magnesium granules, with a metal magnesium recovery rate of 92%.

Embodiment 4

The method for smelting magnesium quickly and continuously specifically comprises the following steps of:

Step 1: Ingredient Preparing and Pelletizing ingredient preparing: preparing dolomite, Al and fluorite at a mass ratio of 115:10:2.0, and then adding soluble glass as a bonding agent which accounts for 1.0% of the total mass of the above three ingredients and water which accounts for 4.5% of the total mass of the above three ingredients;

pelletizing: uniformly mixing the prepared ingredients so as to obtain a mixture, pelletizing the mixture through the disc pelletizer so as to obtain pellets with particle sizes of 5-20 mm, and naturally drying the pellets for 6 h;

Step 2: Pellet Calcining placing the dried pellets in the rotary kiln, heating the dried pellets to 150° C., keeping the temperature for 60 min, dehydrating the dried pellets after the temperature is kept, then heating the dehydrated dried pellets to 850° C. in an argon atmosphere, keeping the temperature, and performing calcination for 120 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1300° C., a reduction time of 90 min, and a argon flow rate of 2.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 91.5%.

Embodiment 5

The method for smelting magnesium quickly and continuously specifically comprises the following steps of:

Step 1: Ingredient Preparing and Pelletizing ingredient preparing: preparing dolomite, Al and fluorite at a mass ratio of 115:12:2.5, and then adding soluble glass as a bonding agent which accounts for 1.5% of the total mass of the above three ingredients and water which accounts for 3.0% of the total mass of the above three ingredients;

pelletizing: uniformly mixing the prepared ingredients so as to obtain a mixture, pelletizing the mixture through the disc pelletizer so as to obtain pellets with particle sizes of 5-20 mm, and naturally drying the pellets for 2 h;

Step 2: Pellet Calcining placing the dried pellets in the rotary kiln, heating the dried pellets to 220° C., keeping the temperature for 50 min, dehydrating the dried pellets after the temperature is kept, then heating the dehydrated dried pellets to 950° C. in an argon atmosphere, keeping the temperature, and performing calcination for 50 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1500° C., a reduction time of 45 min, and an argon flow rate of 4.2 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 93.0%.

Embodiment 6

The method for smelting magnesium quickly and continuously specifically comprises the following steps of:

Step 1: Ingredient Preparing and Pelletizing ingredient preparing: preparing dolomite, Al and fluorite at a mass ratio of 115:13:3.0, and then adding soluble glass as a bonding agent which accounts for 2.0% of the total mass of the above three ingredients and water which accounts for 2.0% of the total mass of the above three ingredients;

pelletizing: uniformly mixing the prepared ingredients so as to obtain a mixture, pelletizing the mixture with a disc pelletizer so as to obtain pellets with particle sizes of 5-15 mm, and naturally drying the pellets for 20 h;

Step 2: Pellet Calcining placing the dried pellets in the rotary kiln, heating the dried pellets to 180° C., keeping the temperature for 55 min, dehydrating the dried pellets after the temperature is kept, then heating the dehydrated dried pellets to 900° C. in an argon atmosphere, keeping the temperature, and performing calcination for 60 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1550° C., a reduction time of 20 min, and an argon flow rate of 5.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 93.5%.

Embodiment 7

The method for smelting magnesium quickly and continuously specifically comprises the following steps of:

Step 1: Ingredient Preparing and Pelletizing ingredient preparing: preparing magnesite, 75 Si—Fe alloy, CaO and fluorite at a mass ratio of 45:10:16:2.0, and then adding soluble glass as a bonding agent which accounts for 2.0% of the total mass of the above four ingredients and water which accounts for 6.0% of the total mass of the above four ingredients;

pelletizing: uniformly mixing the prepared ingredients so as to obtain a mixture, pelletizing the mixture with a disc pelletizer to obtain pellets with particle sizes of 5-20 mm, and naturally drying the pellets for 18 h;

Step 2: Pellet Calcining placing the dried pellets in the rotary kiln, heating the dried pellets to 200° C., keeping the temperature for 35 min, dehydrating the dried pellets after the temperature is kept, then heating the dehydrated dried pellets to 1050° C. in an argon atmosphere, keeping the temperature, and performing calcination for 40 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1300° C., a reduction time of 90 min, and an argon flow rate of 3.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a jet atomizer for atomizing condensation to obtain metal magnesium granules, with a metal magnesium recovery rate of 90%.

Embodiment 8

The method for smelting magnesium quickly and continuously specifically comprises the following steps of:

Step 1: Ingredient Preparing and Pelletizing ingredient preparing: preparing magnesite, 75Si—Fe alloy, CaO and fluorite at a mass ratio of 45:12:18:2.5, and then adding soluble glass as a bonding agent which accounts for 2.5% of the total mass of the above four ingredients and water which accounts for 5.0% of the total mass of the above four ingredients;

pelletizing: uniformly mixing the prepared ingredients so as to obtain a mixture, pelletizing the mixture with a disc pelletizer so as to obtain pellets with particle sizes of 10-25 mm, and naturally drying the pellets for 10 h;

Step 2: Pellet Calcining placing the dried pellets in the rotary kiln, heating the dried pellets to 250° C., keeping the temperature for 40 min, dehydrating the dried pellets after the temperature is kept, then heating the dehydrated dried pellets to 1000° C. in an argon atmosphere, keeping the temperature, and performing calcination for 90 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1400° C., a reduction time of 50 min, and an argon flow rate of 4.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 91%.

Embodiment 9

The method for smelting magnesium quickly and continuously specifically comprises the following steps of:

Step 1: Ingredient Preparing and Pelletizing ingredient preparing: preparing magnesite, 75Si—Fe alloy, CaO and fluorite at a mass ratio of 45:13:20:3.0, and then adding soluble glass as a bonding agent which accounts for 3.0% of the total mass of the above four ingredients and water which accounts for 3.0% of the total mass of the above four ingredients;

pelletizing: uniformly mixing the prepared ingredients so as to obtain a mixture, pelletizing the mixture with a disc pelletizer so as to obtain pellets with particle sizes of 5-25 mm, and naturally drying the pellets for 15 h;

Step 2: Pellet Calcining placing the dried pellets in the rotary kiln, heating the dried pellets to 210° C., keeping the temperature for 50 min, dehydrating the dried pellets after the temperature is kept, then heating the dehydrated dried pellets to 950° C. in an argon atmosphere, keeping the temperature, and performing calcination for 70 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1600° C., a reduction time of 20 min, and an argon flow rate of 5.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 95%.

Embodiment 10

The method for smelting magnesium quickly and continuously specifically comprises the following steps of:

Step 1: Ingredient Preparing and Pelletizing ingredient preparing: preparing magnesite, Al, CaO and fluorite at a mass ratio of 48:10:15:2.0, and then adding soluble glass as a bonding agent which accounts for 2.0% of the total mass of the above four ingredients and water which accounts for 6.0% of the total mass of the above four ingredients;

pelletizing: uniformly mixing the prepared ingredients so as to obtain a mixture, pelletizing the mixture with a disc pelletizer to obtain pellets with particle sizes of 5-25 mm, and naturally drying the pellets for 8 h;

Step 2: Pellet Calcining placing the dried pellets in the rotary kiln, heating the dried pellets to 200° C., keeping the temperature for 50 min, dehydrating the dried pellets after the temperature is kept, then heating the dehydrated dried pellets to 950° C. in an argon atmosphere, keeping the temperature, and performing calcination for 120 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1300° C., a reduction time of 80 min, and an argon flow rate of 3.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with an metal magnesium recovery rate of 91%.

Embodiment 11

The method for smelting magnesium quickly and continuously specifically comprises the following steps of:

Step 1: Ingredient Preparing and Pelletizing ingredient preparing: preparing magnesite, Al, CaO and fluorite at a mass ratio of 48:12:17:2.5, and then adding soluble glass as a bonding agent which accounts for 2.5% of the total mass of the above four ingredients and water which accounts for 2.0% of the total mass of the above four ingredients;

pelletizing: uniformly mixing the prepared ingredients so as to obtain a mixture, pelletizing the mixture with a disc pelletizer to obtain pellets with particle sizes of 5-25 mm, and naturally drying the pellets for 1 h;

Step 2: Pellet Calcining placing the dried pellets in the rotary kiln, heating the dried pellets to 190° C., keeping the temperature for 60 min, dehydrating the dried pellets after the temperature is kept, then heating the dehydrated dried pellets to 900° C. in an argon atmosphere, keeping the temperature, and performing calcination for 100 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1450° C., a reduction time of 40 min, and an argon flow rate of 4.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 94%.

Embodiment 12

The method for smelting magnesium quickly and continuously specifically comprises the following steps of:

Step 1: Ingredient Preparing and Pelletizing ingredient preparing: preparing magnesite, Al, CaO and fluorite at a mass ratio of 48:13:18:3.0, and then adding soluble glass as a bonding agent which accounts for 3.0% of the total mass of the above four ingredients and water which accounts for 5.0% of the total mass of the above four ingredients;

pelletizing: uniformly mixing the prepared ingredients so as to obtain a mixture, pelletizing the mixture with a disc pelletizer so as to obtain pellets with particle sizes of 5-25 mm, and naturally drying the pellets for 1 h;

Step 2: Pellet Calcining placing the dried pellets in the rotary kiln, heating the dried pellets to 200° C., keeping the temperature for 45 min, dehydrating the dried pellets after the temperature is kept, then heating the dehydrated dried pellets to 850° C. in an argon atmosphere, keeping the temperature, and performing calcination for 120 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1600° C., a reduction time of 20 min, and an argon flow rate of 5.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation so as to obtain metal magnesium ingots, with a metal magnesium recovery rate of 96%.

Embodiment 13

The method for smelting magnesium quickly and continuously specifically comprises the following steps of:

Step 1: Ingredient Preparing and Pelletizing ingredient preparing: preparing dolomite, Al, 75Si—Fe alloy and fluorite at a mass ratio of 110:3.0:6.5:3.0, and then adding soluble glass as a bonding agent which accounts for 1.0% of the total mass of the above four ingredients and water which accounts for 4.0% of the total mass of the above four ingredients;

pelletizing: uniformly mixing the prepared ingredients so as to obtain a mixture, pelletizing the mixture with a disc pelletizer so as to obtain pellets with particle sizes of 5-20 mm, and naturally drying the pellets for 24 h;

Step 2: Pellet Calcining placing the dried pellets in the high-temperature furnace, heating the dried pellets to 200° C., keeping the temperature for 50 min, dehydrating the dried pellets after the temperature is kept, then heating the dehydrated dried pellets to 1000° C. in an argon atmosphere, keeping the temperature, and performing calcination for 30 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1350° C., a reduction time of 90 min, and an argon flow rate of 4.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation to obtain magnesium ingots, with a metal magnesium recovery rate of 90%.

Embodiment 14

The method for smelting magnesium quickly and continuously specifically comprises the following steps of:

Step 1: Ingredient Preparing and Pelletizing ingredient preparing: preparing magnesite, Ca, 75Si—Fe alloy, CaO and fluorite at a mass ratio of 45:17.6:3:16:2.0, and then adding soluble glass as a bonding agent which accounts for 2.0% of the total mass of the above five ingredients and water which accounts for 6.0% of the total mass of the above five ingredients;

pelletizing: uniformly mixing the prepared ingredients so as to obtain a mixture, pelletizing the mixture so as to obtain pellets with particle sizes of 5-20 mm, and naturally drying the pellets for 20 h;

Step 2: Pellet Calcining placing the dried pellets in the rotary kiln, heating the dried pellets to 210° C., keeping the temperature for 35 min, dehydrating the dried pellets after the temperature is kept, then heating the dehydrated dried pellets to 1050° C. in an argon atmosphere, keeping the temperature, and performing calcination for 40 min;

Step 3: Continuous High-Temperature Reduction of Calcined Pellets continuously feeding the high-temperature calcined pellets (without being cooled) under argon protection into a high-temperature resistance furnace through a sealed pipeline, then performing a continuous high-temperature reduction reaction in a flowing argon atmosphere with a reduction temperature of 1320° C., a reduction time of 85 min, and an argon flow rate of 3.0 $m^3$/h in order to continuously obtain high-temperature magnesium steam, mixing the magnesium steam with argon gas to form a high-temperature gas mixture, and besides continuously discharging reduction slag out of the high-temperature resistance furnace; and Step 4: Condensing of High-Temperature Magnesium Steam enabling the high-temperature magnesium steam to be carried out of the high-temperature resistance furnace by flowing argon stream, and then to be carried directly by the sealed pipeline into a jet atomizer for direct atomizing condensation to obtain metal magnesium granules, with a metal magnesium recovery rate of 92%.

Embodiment 15

The method for smelting magnesium quickly and continuously specifically comprises the following steps of:

Step 1: Ingredient Preparing and Pelletizing ingredient preparing: preparing dolomite, Al, Ca, 75Si—Fe alloy and fluorite at a mass ratio of 110:2.7:8.8:5:4.0, and then adding soluble glass as a bonding agent which accounts for 2.0% of the total mass of the above five ingredients and water which accounts for 4.0% of the total mass of the above five ingredients;

pelletizing: uniformly mixing the prepared ingredients so as to obtain a mixture, pelletizing the mixture with a disc pelletizer to obtain pellets with particle sizes of 5-20 mm, and naturally drying the pellets for 15 h;

Step 2: Pellet Calcining placing the dried pellets in the fluidized bed, heating the dried pellets to 240° C., keeping the temperature for 40 min, dehydrating the dried pellets after the temperature is kept, then heating the dehydrated dried pellets to 980° C. in a highly pure nitrogen atmosphere, keeping the temperature, and performing calcination for 60 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1500° C., a reduction time of 20 min, and a argon flow rate of 5.0 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a jet atomizer for direct atomizing condensation to obtain metal magnesium granules, with a metal magnesium recovery rate of 91%.

Embodiment 16

The method for smelting magnesium quickly and continuously specifically comprises the following steps of:

Step 1: Ingredient Preparing and Pelletizing ingredient preparing: preparing magnesite, Al, 75Si—Fe alloy, CaO and fluorite at a mass ratio of 48:4.6:7:15:2.0, and then adding soluble glass as a bonding agent which accounts for 2.0% of the total mass of the above five ingredients and water which accounts for 6.0% of the total mass of the above five ingredients;

pelletizing: uniformly mixing the prepared ingredients so as to obtain a mixture, pelletizing the mixture with a disc pelletizer to obtain pellets with particle sizes of 5-25 mm, and naturally drying the pellets for 10 h;

Step 2: Pellet Calcining placing the dried pellets in the rotary kiln, heating the dried pellets to 200° C., keeping the temperature for 45 min, dehydrating the dried pellets after the temperature is kept, then heating the dehydrated dried pellets to 950° C. in an argon atmosphere, keeping the temperature, and performing calcination for 120 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1400° C., a reduction time of 75 min, and an argon flow rate of 3.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation to obtain metal magnesium ingots, with a metal magnesium recovery rate of 91%.

Embodiment 17

The method for smelting magnesium quickly and continuously specifically comprises the following steps of:

Step 1: Ingredient Preparing and Pelletizing ingredient preparing: preparing dolomite, Al, Ca, 75Si—Fe alloy and fluorite at a mass ratio of 115:6.6:6.6:2.5:3.0, and then adding soluble glass as a bonding agent which accounts for 2.0% of the total mass of the above five ingredients and water which accounts for 2.0% of the total mass of the above five ingredients;

pelletizing: uniformly mixing the prepared ingredients so as to obtain a mixture, pelletizing the mixture with a disc pelletizer to obtain pellets with particle sizes of 5-20 mm, and naturally drying the pellets for 18 h;

Step 2: Pellet Calcining placing the dried pellets in the rotary kiln, heating the dried pellets to 200° C., keeping the temperature for 50 min, dehydrating the dried pellets after the temperature is kept, then heating the dehydrated dried pellets to 900° C. in an argon atmosphere, keeping the temperature, and performing calcination for 60 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1500° C., a reduction time of 25 min, and an argon flow rate of 4.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation to obtain metal magnesium ingots, with a metal magnesium recovery rate of 94%.

Embodiment 18

The method for smelting magnesium quickly and continuously specifically comprises the following steps of:

Step 1: Ingredient Preparing and Pelletizing ingredient preparing: preparing dolomite, Ca, 75Si—Fe alloy and fluorite at a mass ratio of 115:15.4:6:2.0, and then adding soluble glass as a bonding agent which accounts for 1.0% of the total mass of the above four ingredients and water which accounts for 4.5% of the total mass of the above four ingredients;

pelletizing: uniformly mixing the prepared ingredients so as to obtain a mixture, pelletizing the mixture with a disc pelletizer to obtain pellets with particle sizes of 5-20 mm, and naturally drying the pellets for 10 h;

Step 2: Pellet Calcining placing the dried pellets in the rotary kiln, heating the dried pellets to 180° C., keeping the temperature for 55 min, dehydrating the dried pellets after the temperature is kept, then heating the dehydrated dried pellets to 850° C. in an argon atmosphere, keeping the temperature, and performing calcination for 120 min;

Step 3: Continuous High-Temperature Reduction of Calcined Pellets continuously feeding the high-temperature calcined pellets (without being cooled) under argon protection into a medium-frequency induction furnace through a sealed pipeline, then performing a continuous high-temperature reduction reaction in a flowing argon atmosphere with a reduction temperature of 1350° C., a reduction time of 80 min, and an argon flow rate of 3.5 $m^3$/h in order to continuously obtain high-temperature magnesium steam, mixing the magnesium steam with argon gas to form a high-temperature gas mixture, and besides continuously discharging reduction slag out of the medium-frequency induction furnace; and Step 4: Condensing of High-Temperature Magnesium Steam enabling the high-temperature magnesium steam to be carried out of the medium-frequency induction furnace by flowing argon stream, and then to be carried directly by the sealed pipeline into a magnesium condensing tank for circulating water cooling condensation to obtain metal magnesium ingots, with a metal magnesium recovery rate of 93%.

What is claimed is:

1. A method for smelting magnesium quickly and continuously, comprising the following steps of:

Step 1: ingredient preparing and pelletizing ingredient preparing: preparing dolomite, 75Si—Fe alloy and fluorite at a mass ratio of 110:(10-13):(3.0-4.0), uniformly mixing the prepared ingredients so as to obtain a mixture, and then adding soluble glass as a bonding agent which accounts for 1.0-2.0% of the total mass of the prepared ingredients and water which accounts for 2.0-5.0% of the total mass of the prepared ingredients;

or, preparing dolomite, Al and fluorite at a mass ratio of 115:(10-13):(2.0-3.0), uniformly mixing the prepared ingredients so as to obtain a mixture, and then adding soluble glass as a bonding agent which accounts for 1.0-2.0% of the total mass of the prepared ingredients and water which accounts for 2.0-5.0% of the total mass of the prepared ingredients;

pelletizing: uniformly mixing the prepared ingredients so as to obtain a mixture, pelletizing the mixture so as to obtain pellets with particle sizes of 5-20 mm, and naturally drying the pellets for 10-24 h;

Step 2: pellet calcining placing the dried pellets in a high-temperature furnace, a rotary kiln or a fluidized bed, heating the dried pellets to 150-250° C., keeping the temperature for 30-60 min, dehydrating the dried pellets after the temperature is kept, then heating the dehydrated dried pellets to 850-1050° C. in an argon or nitrogen atmosphere, keeping the temperature, and performing calcination for 30-120 min;

Step 3: continuous high-temperature reduction of calcined pellets continuously feeding the high-temperature calcined pellets without being cooled under argon protection into a closed high-temperature reduction furnace, then performing a high-temperature reduction reaction in a flowing argon atmosphere with a reduction temperature of 1300-1600° C., a reduction time of 20-90 min, and an argon flow rate of 2.0-5.0 $m^3/h$ in order to continuously obtain high-temperature magnesium steam, mixing the magnesium steam with argon gas to form a high-temperature gas mixture, and besides, continuously discharging reduction slag out of the high-temperature reduction furnace; and Step 4: condensing of high-temperature magnesium steam enabling the high-temperature magnesium steam to be carried out of the high-temperature reduction furnace by the argon flow, and to be delivered through a sealed pipeline to a condensation system for condensation so as to obtain metal magnesium.

2. A method for smelting magnesium quickly and continuously, comprising the following steps of:

Step 1: ingredient preparing and pelletizing ingredient preparing: preparing magnesite, 75Si—Fe alloy, CaO and fluorite at a mass ratio of 45:(10-13):(16-20):(2.0-3.0), uniformly mixing the prepared ingredients so as to obtain a mixture, and then adding soluble glass as a bonding agent which accounts for 2.0-3.0% of the total mass of the prepared ingredients and water which accounts for 2.0-6.0% of the total mass of the prepared ingredients;

or, preparing magnesite, Al, CaO and fluorite at a mass ratio of 48:(10-13):(15-18):(2.0-3.0), uniformly mixing the prepared ingredients so as to obtain a mixture, and then adding soluble glass as a bonding agent which accounts for 2.0-3.0% of the total mass of the prepared ingredients and water which accounts for 2.0-6.0% of the total mass of the prepared ingredients;

Step 2: pellet calcining placing the dried pellets in a high-temperature furnace, a rotary kiln or a fluidized bed, heating the dried pellets to 150-250° C., keeping the temperature for 30-60 min, dehydrating the dried pellets after the temperature is kept, then heating the dehydrated dried pellets to 850-1050° C. in an argon or nitrogen atmosphere, keeping the temperature, and performing calcination for 30-120 min;

Step 3: continuous high-temperature reduction of calcined pellets continuously feeding the high-temperature calcined pellets without being cooled under argon protection into a closed high-temperature reduction furnace, then performing a high-temperature reduction reaction in a flowing argon atmosphere with a reduction temperature of 1300-1600° C., a reduction time of 20-90 min, and an argon flow rate of 2.0-5.0 $m^3/h$ in order to continuously obtain high-temperature magnesium steam, mixing the magnesium steam with argon gas to form a high-temperature gas mixture, and besides, continuously discharging reduction slag out of the high-temperature reduction furnace; and Step 4: condensing of high-temperature magnesium steam enabling the high-temperature magnesium steam to be carried out of the high-temperature reduction furnace by the argon flow, and to be delivered through a sealed pipeline to a condensation system for condensation so as to obtain metal magnesium.

3. The method for smelting magnesium quickly and continuously according to claim 1, wherein the Al or 75Si—Fe alloy in Step 1 is replaced with composite reductants selected from one of the following three groups:

(1) Al+75Si—Fe alloys; (2) Ca+75Si—Fe alloys; (3) Al+Ca+75Si—Fe alloy;

the standard dosage of the composite reductants are: 1 mass unit of Al can be replaced with 2.2 mass units of Ca; 1 mass unit of 75Si—Fe alloy can be replaced with 2.2 mass units of Ca; and 1 mass unit of Al is equivalent to 1 mass unit of 75Si—Fe alloy.

4. The method for smelting magnesium quickly and continuously according to claim 1, wherein the condensing way in Step 4 is in direct condensation or atomizing condensation.

5. The method for smelting magnesium quickly and continuously according to claim 2, wherein the Al or 75Si—Fe alloy in Step 1 is replaced with composite reductants selected from one of the following three groups:

(1) Al+75Si—Fe alloys; (2) Ca+75Si—Fe alloys; (3) Al+Ca+75Si—Fe alloy;

the standard dosage of the composite reductants are: 1 mass unit of Al can be replaced with 2.2 mass units of Ca; 1 mass unit of 75Si—Fe alloy can be replaced with 2.2 mass units of Ca; and 1 mass unit of Al is equivalent to 1 mass unit of 75Si—Fe alloy.

6. The method for smelting magnesium quickly and continuously according to claim 2, wherein the condensing way in Step 4 is in direct condensation or atomizing condensation.

* * * * *